US009643414B2

(12) United States Patent
Sohgawa et al.

(10) Patent No.: US 9,643,414 B2
(45) Date of Patent: May 9, 2017

(54) DEVICE TO DISCHARGE LIQUID AND HEAD DRIVING METHOD

(71) Applicants: Norimasa Sohgawa, Kanagawa (JP); Satomi Araki, Kanagawa (JP); Shinichiroh Osanai, Kanagawa (JP)

(72) Inventors: Norimasa Sohgawa, Kanagawa (JP); Satomi Araki, Kanagawa (JP); Shinichiroh Osanai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/245,577

(22) Filed: Aug. 24, 2016

(65) Prior Publication Data

US 2017/0066236 A1 Mar. 9, 2017

(30) Foreign Application Priority Data

Sep. 8, 2015 (JP) ..... 2015-176949

(51) Int. Cl.
*B41J 2/045* (2006.01)
*B41J 29/38* (2006.01)
(Continued)

(52) U.S. Cl.
CPC ..... *B41J 2/04588* (2013.01); *B41J 2/04581* (2013.01); *B41J 2/04596* (2013.01); *B41J 2/14201* (2013.01); *B41J 2/155* (2013.01)

(58) Field of Classification Search
CPC B41J 2/04588; B41J 2/04581; B41J 2/04596; B41J 2/04573; B41J 29/38; B41J 2/14201; B41J 2/155
See application file for complete search history.

(56) References Cited

U.S. PATENT DOCUMENTS 7,384,128 B2 * 6/2008 Sheahan ..... B41J 2/0451 347/40
2014/0218428 A1 8/2014 Araki et al.
(Continued)

FOREIGN PATENT DOCUMENTS

JP 2001-158115 6/2001
JP 2002-127418 5/2002
(Continued)

*Primary Examiner* — Thinh H Nguyen
(74) *Attorney, Agent, or Firm* — Harness, Dickey & Pierce, P.L.C.

(57) ABSTRACT

A device to discharge liquid includes a liquid discharging head to discharge the liquid and a drive waveform generating device to generate and output a drive waveform including continuous multiple drive pulses to discharge the liquid from the liquid discharging head that are continuously arranged in chronological order to form a single droplet. The continuous multiple drive pulses include an inflation waveform element to inflate an individual liquid chamber of the liquid discharging head and a contraction waveform element to contract the inflated individual liquid chamber to discharge the liquid. When the wave element between the continuous multiple drive pulses is determined as the holding wave element between pulses, the voltage held by the holding waveform element is higher than the initial voltage of the inflation waveform element of the first drive pulse and the ending voltage of the contraction waveform element of the last drive pulse.

9 Claims, 12 Drawing Sheets

(51) Int. Cl.
*B41J 2/155* (2006.01)
*B41J 2/14* (2006.01)

(56) References Cited

U.S. PATENT DOCUMENTS

| | | | |
|---|---|---|---|
| 2015/0251414 | A1 | 9/2015 | Araki |
| 2016/0075132 | A1 | 3/2016 | Kitaoka et al. |

FOREIGN PATENT DOCUMENTS

| | | |
|---|---|---|
| JP | 2009-160865 | 7/2009 |
| JP | 2014-144569 | 8/2014 |

* cited by examiner

DISCHARGING FIRST DROPLET

EXTRUDING FIRST DROPLET

DRAWING SUBSEQUENT DROPLET

DISCHARGING SUBSEQUENT DROPLET

DROPLETS MERGED

EMBODIMENT

FIRST COMPARATIVE EXAMPLE

SECOND COMPARATIVE EXAMPLE

DEVICE TO DISCHARGE LIQUID AND HEAD DRIVING METHOD

CROSS-REFERENCE TO RELATED APPLICATIONS

This patent application is based on and claims priority pursuant to 35 U.S.C. §119 to Japanese Patent Application No. 2015-176949, filed on Sep. 8, 2015, in the Japan Patent Office, the entire disclosure of which is hereby incorporated by reference herein.

BACKGROUND

Technical Field

The present invention relates to a device to discharge liquid and a head driving method.

Description of the Related Art

When a liquid discharging head is driven and controlled to discharge liquid, a drive waveform including multiple drive pulses is generated and output to discharge the liquid in a single drive cycle in such a manner that the liquid discharged by the multiple drive pulses is merged to form a desired droplet.

A typically known configuration includes a drive signal supplying device to supply to a piezoelectric element a drive voltage signal including a negative voltage to drive an actuator to reduce the pressure in a pressure chamber and a positive voltage to drive the actuator to increase the pressure in the pressure chamber and supplies an initial drive pulse formed of a voltage descending waveform to descend a referential voltage between a predetermined negative voltage and a predetermined positive voltage to a negative voltage, a negative voltage holding waveform to hold the negative voltage, and a voltage ascending waveform ascending the negative voltage to a positive voltage, and a single or multiple subsequent drive pulses formed of a positive voltage holding waveform to hold the positive voltage, a voltage descending waveform descending the positive voltage to a negative voltage, a negative voltage holding waveform to hold the negative voltage, and a voltage ascending waveform ascending the negative voltage to a positive voltage in a predetermined single print cycle.

In a case in which multiple drive pulses are continuously applied to a liquid discharging head to form a single droplet, it is necessary to increase the number of drive pulses or the crest value of a single drive pulse to increase the volume of the single droplet.

However, as the number of drive pulses increase, the waveform length of the drive waveform becomes longer. Similarly, as the crest value of a single drive pulse increase, the waiting time for a meniscus to be stabilized becomes longer, thereby prolonging the waveform length of the drive waveform. If the drive waveform length is prolonged, the drive frequency lowers.

SUMMARY

According to the present invention, provided is an improved device to discharge liquid which includes a liquid discharging head to discharge liquid and a drive waveform generating device to generate and output a drive waveform. The drive waveform includes continuous multiple drive pulses to discharge the liquid from the liquid discharging head that are continuously arranged in chronological order to discharge the liquid to form a single droplet of the liquid. The continuous multiple drive pulses include a first inflation waveform element to inflate an individual liquid chamber of the liquid discharging head and a first contraction waveform element to contract the inflated individual liquid chamber to discharge the liquid. When the wave element between the continuous multiple drive pulses is determined as a holding wave element between pulses, of the continuous multiple drive pulses, the voltage held by the holding waveform element between pulses is higher than each one of the first initial voltage of the first inflation waveform element of the first drive pulse in chronological order and the first ending voltage of the first contraction waveform element of the last drive pulse in chronological order.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

The present disclosure is to increase the volume of a droplet while suppressing a decrease of the drive frequency.

Figure 1:
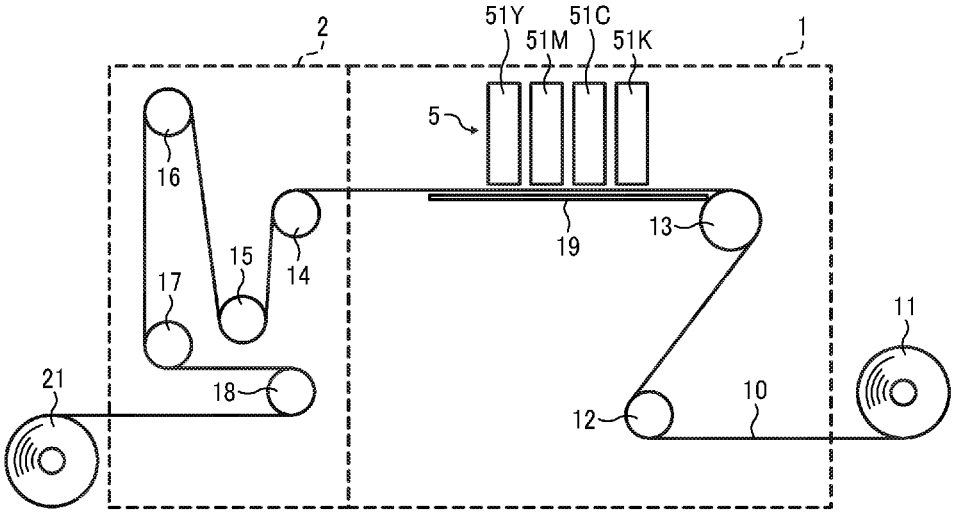
FIG. 1 is a side view of an example of a device to discharge liquid according to an embodiment of the present disclosure.

Embodiments of the present disclosure are described with reference to the accompanying drawings. One embodiment of the device to discharge liquid of the present disclosure is described with reference to FIG. 1. FIG. 1 is a schematic diagram illustrating the device.

The device to discharge liquid includes a full line type head. The device to discharge liquid has a device 1 and an exit unit 2 arranged side by side. The exit unit 2 earns time for drying.

In this device, continuous paper is used as a medium 10 onto which liquid is attached. The medium 10 is reeled out from an original reel roller 11, conveyed by conveying rollers 12 to 18, and reeled to a reeling roller 21. The device to which the present disclosure is applied may use sheet-like form media.

This medium 10 is conveyed on a conveying guiding member 19 between the conveying roller 13 and the conveying roller 14, facing a liquid discharging unit 5. An image is formed on the medium 10 with the liquid discharged from the liquid discharging unit 5.

The liquid discharging unit 5 includes, for example, four color full line type head units 51D, 51C, 51M, and 51Y (head unit 51, if color is not distinguished) disposed from upstream in the medium conveying direction. Each head unit 51 individually discharges black D, cyan C, magenta M, and yellow Y to the medium 10 which is being conveyed. The kind and the number of colors are not limited thereto.

Figure 2:
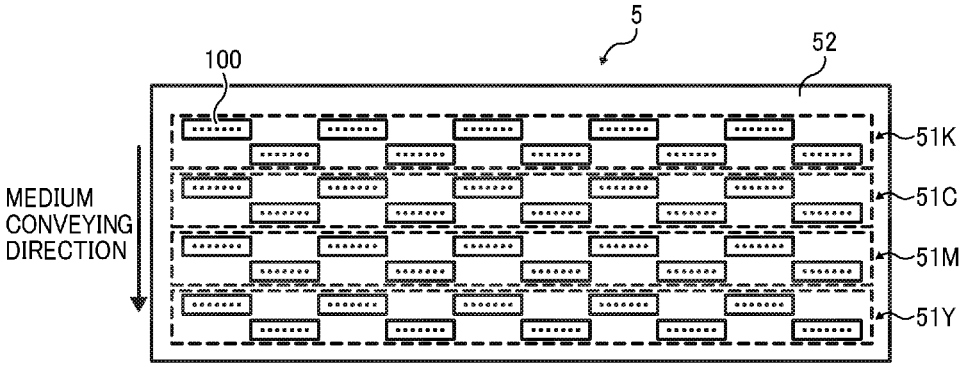
FIG. 2 is a plane diagram illustrating the substantial part of a liquid discharging unit.

For example, as illustrated in FIG. 2, the head unit 51 is a head array in which multiple liquid discharging heads (also referred as "head") 100 are arranged on a base material 52 in a zigzag manner but not limited thereto. In addition, the head unit 51 includes a liquid discharging head and a head tank to supply the liquid to the liquid discharging head but the configuration thereof is not limited thereto. For example, a configuration including only the liquid discharging head is also allowed.

Figure 3:
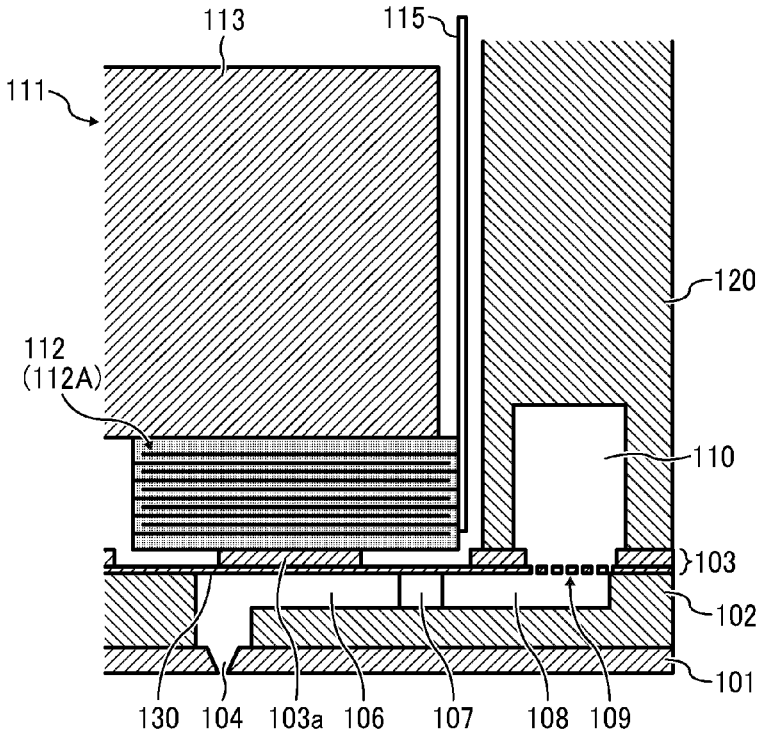
FIG. 3 is a cross section illustrating an example of a liquid discharging head in a liquid chamber longitudinal direction.
Figure 4:
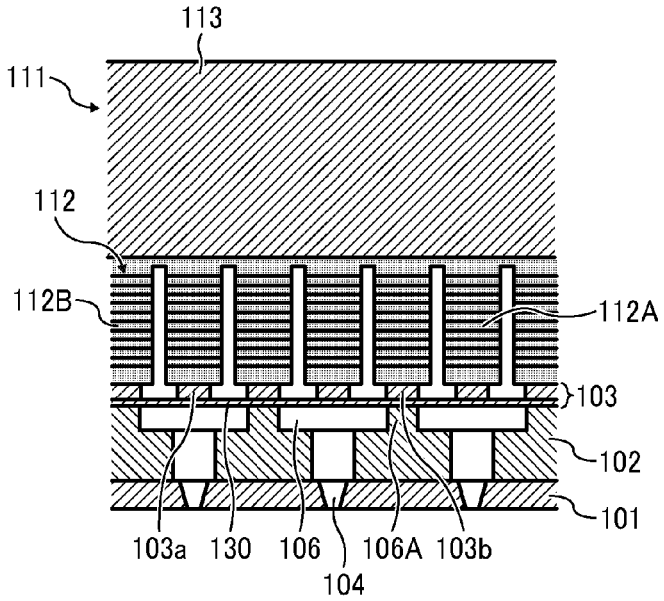
FIG. 4 is a cross section for use in the description of a droplet discharging operation.

Next, an embodiment of the liquid discharging head constituting the head unit is described with reference to FIGS. 3 and 4. FIG. 3 is a cross section in the direction (longitudinal direction of liquid chamber) vertical to the nozzle arrangement direction of the head and FIG. 4 is a cross section in the direction (latitudinal direction of liquid chamber) of the nozzle arrangement of the head.

In the liquid discharging head, a nozzle plate 101, a flow path plate 102, and a vibration plate member 103 are jointed. Also, the head includes a piezoelectric actuator 111 to displace the vibration plate member 103 and a frame member 120 as a common flow path member.

As a result, an individual liquid chamber (also referred to as pressure chamber or pressurizing chamber) communicating with multiple nozzles 104 to discharge liquid droplets, a liquid supplying path 107 doubled as a fluid resistance to supply the liquid to the individual liquid chamber 106, and a liquid introduction unit 108 that communicates with the liquid supplying path 107 are formed. Adjacent individual liquid chambers 106 are separated by a barrier 106A in the nozzle arrangement direction.

The liquid is introduced from a common liquid chamber 110 serving as the common flow path of the frame member 120 into the multiple individual liquid chamber 106 via the liquid introduction unit 108 and the liquid supplying path 107 through a filter unit 109 formed on the vibration plate member 103.

The piezoelectric actuator 111 is disposed facing the individual chamber 106 with a vibration area 130 therebetween. The vibration area 130 is deformable and forms the wall of the individual liquid chamber 106 of the vibration plate member 103.

The piezoelectric actuator 111 includes multiple laminate piezoelectric members 112 jointed on a base member 113. This piezoelectric member 112 is groove-processed by half cut dicing. Piezoelectric elements (piezoelectric pillars) 112A to provide a drive waveform and a support 112B are formed on the piezoelectric member 112 in a pectinate manner spaced a predetermined distance therebetween.

The piezoelectric element 112A is jointed to a convex part 103*a* having an island-like form formed on the vibration area 130 of the vibration plate member 103. In addition, the support 112B is jointed to a convex part 103*b* of the vibration plate member 103.

In the piezoelectric member 112, piezoelectric layers and inside electrodes are alternately laminated. The internal electrodes are individually exposed to end surfaces to provide an external electrode. An FPC 115 serving as a flexible wiring substrate is connected with the piezoelectric member 112 to provide a drive waveform to the external electrode of the piezoelectric element 112A.

The frame member 120 includes the common liquid chamber 110 where the liquid is supplied from a head tank or a liquid cartridge.

In the liquid discharging head having such a configuration, the piezoelectric element 112A contracts by, for example, lowering the voltage applied to the piezoelectric element 112A from an intermediate voltage (reference voltage). For this reason, the vibration area 130 of the vibration plate member 103 is lowered, thereby inflating the volume of the individual liquid chamber 106 so that the liquid flows into the individual liquid chamber 106.

Thereafter, the voltage applied to the piezoelectric element 112A is raised to elongate the piezoelectric element 112A in the lamination direction, thereby deforming the vibration area 130 of the vibration plate member 103 toward the nozzle 104 direction so that the volume of the individual liquid chamber 106 shrinks. For this reason, the liquid in the liquid chamber 106 is pressurized so that the liquid is discharged (jetted) through the nozzle 104.

Thereafter, the voltage applied to the piezoelectric element 112A is returned to the reference voltage. As a consequence, the vibration area 130 of the vibration plate member 103 is back to the initial position so that the individual liquid chamber 106 inflates, which generates a negative pressure. Therefore, the liquid is supplied from the common liquid chamber 110 to the individual liquid chamber 106 through the liquid supplying path 107. After the vibration of the meniscus surface of the nozzle 104 decays and is stabilized, the system starts operations to discharge next droplets.

Figure 5:
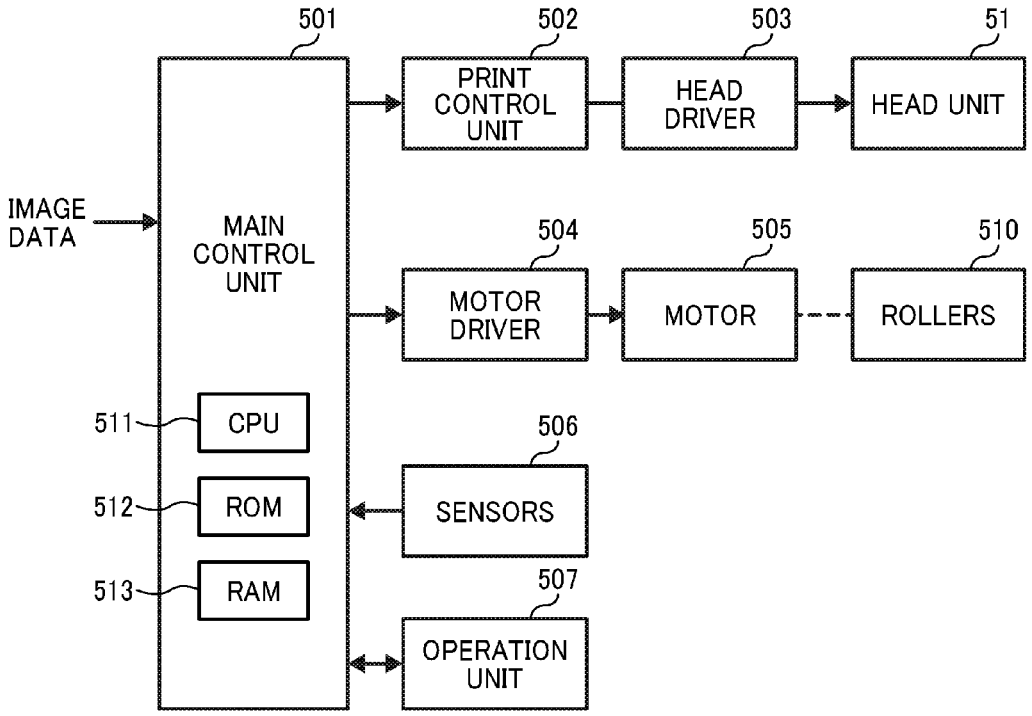
FIG. 5 is a block chart illustrating the control unit of the device to discharge liquid.

Next, the control unit of this device is described with reference to FIG. 5. FIG. 5 is a block diagram illustrating the configuration of the control unit.

This control unit includes a microcomputer including a CPU 511 that controls the entire of the device, a read only memory (ROM) 512, and a random access memory (RAM) 513, and an input/output (I/O), an image memory, and a main control unit (system controller) 501 including a communication interface.

The main control unit 501 sends out print data to a print control unit 502 to form an image on a medium based on the image data and various command information transmitted from an external information processing device (on the host side).

In addition to transfer of serial data of the image data received from the main control unit 501, the print control unit 502 outputs transfer clocks, latch signals, control signals, etc. required to transfer the image data and determine the transfer to a head driver 503.

In addition, the print control unit 502 includes a drive waveform generating unit having a D/A converter to make D/A conversion of pattern data of a common drive pulse stored in an internal ROM, a voltage amplifier, a current amplifier, etc. and outputs a drive waveform constituted of a single or multiple drive pulses to the head driver 503.

The head driver 503 selects a drive pulse constituting a drive waveform provided from the print control unit 502 based on the serially input image data corresponding to a single head unit 51 and provides the selected drive pulse to the piezoelectric element 112A serving as a pressure generating device to discharge the liquid.

At the time of this selection, part or the entire of the drive pulse constituting the drive waveform or part or the entire of the waveform element forming the drive pulse is selected to separately discharge different sizes of droplets such as large droplets, middle-sized droplets, and small droplets.

In addition, the main control unit 501 drives and controls a motor 505 via the motor driver 504 and drives rollers 510 including the original reel roller 11, the conveying rollers 12-18, and the reel roller 21.

In addition, the main control unit 501 receives detection signals from sensors 506 including various sensors, inputs and outputs various information, and sends and receives display information with an operation unit 507.

Figure 6:
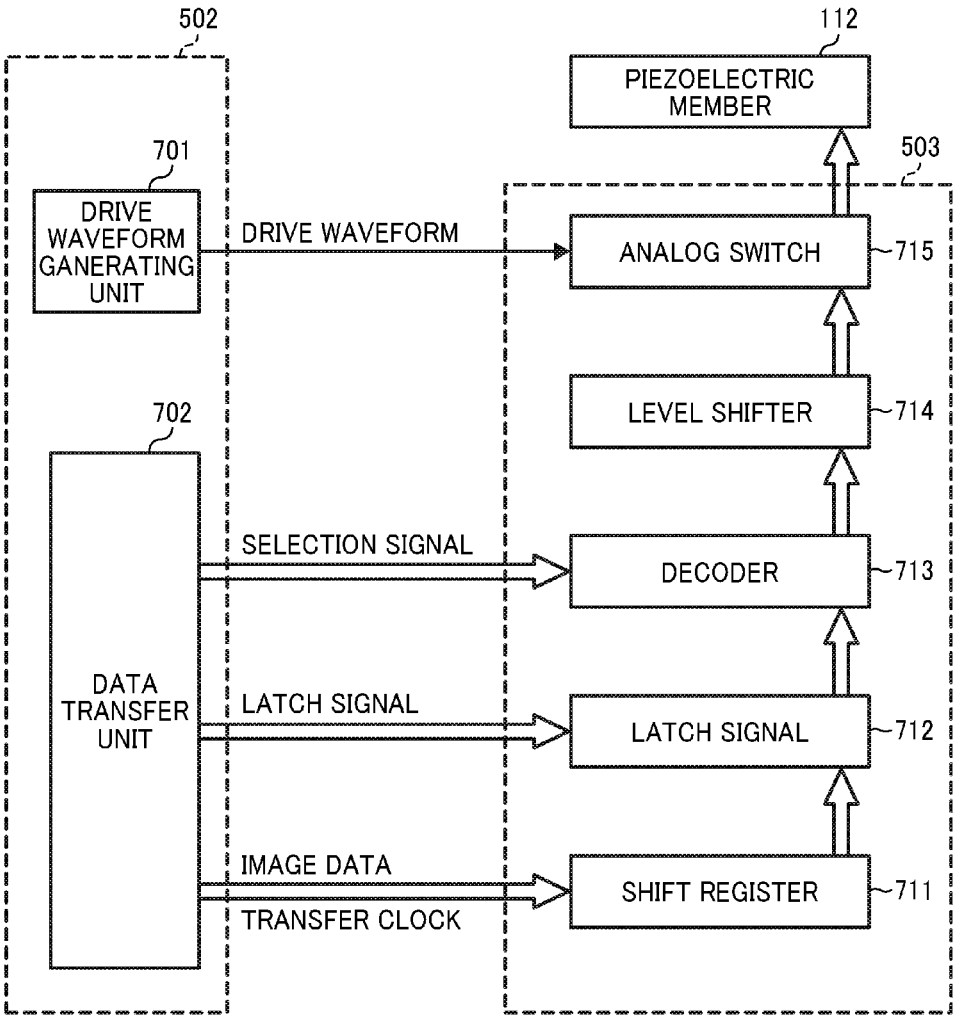
FIG. 6 is a block chart illustrating an example of the print control unit and the head driver of the control unit illustrated in FIG. 5.

Next, embodiments of the print control unit 502 and the head driver 503 are described with reference to the block diagram illustrated in FIG. 6.

The print control unit 502 includes a drive waveform generating unit 701 as the drive waveform generating device to generate and output a common drive waveform Vcom and a data transfer unit 702 to output 2-bit image data (tone signal 0, 1) depending on image data, a cock signal, a latch signal (LAT), and a selection signals for selecting a drive pulse constituting the common drive waveform Vcom.

The drive waveform generating device 701 generates and outputs the common drive waveform Vcom in which multiple drive pulses (also referred to as discharging pulse) to discharge liquid in a single print cycle (single drive cycle) are arranged in chronological order.

In addition, the selection signal instructs off and on of an analog switch 715 serving as the switching device described later of the head driver 503 for each droplet. The selection signal transitions to H level (ON) by a drive pulse (drive waveform element) selected to the print cycle of the common drive waveform Vcom and to L level (OFF) when not selected.

The head driver 503 includes a shift register 711, a latch circuit 712, a decoder 713, a level shifter 714, and an analog switch 715.

The shift register 711 inputs a transfer clock (shift clock) and serial image data (tone data: 2 bit/1 channel, one nozzle) from the data transfer unit 702. The latch circuit 712 latches each register value of the shift register 711 by the latch signal. The decoder 713 decodes the tone data and the selection signal and outputs the results. The level shifter 714 level-changes the logic level voltage signal of the decoder 713 to a level at which the analog switch 715 is operable. The analog switch 715 opens and closes (on and off) depending on the output of the decoder 713 provided via the level shifter 714.

The analog switch 715 is connected with a selective electrode (individual electrode) of each piezoelectric element 112A of the piezoelectric member 112 to receive the common drive waveform Vcom from the drive waveform generating unit 701. Therefore, the analog switch 715 is switched on depending on the result obtained by decoding the serially transferred image data (tone data) and the selection signal by the decoder 713. When the analog switch is switched on, the drive pulse (or waveform element) constituting the common drive waveform Vcom passes (is selected) and is applied the piezoelectric element 112A.

Figure 7:
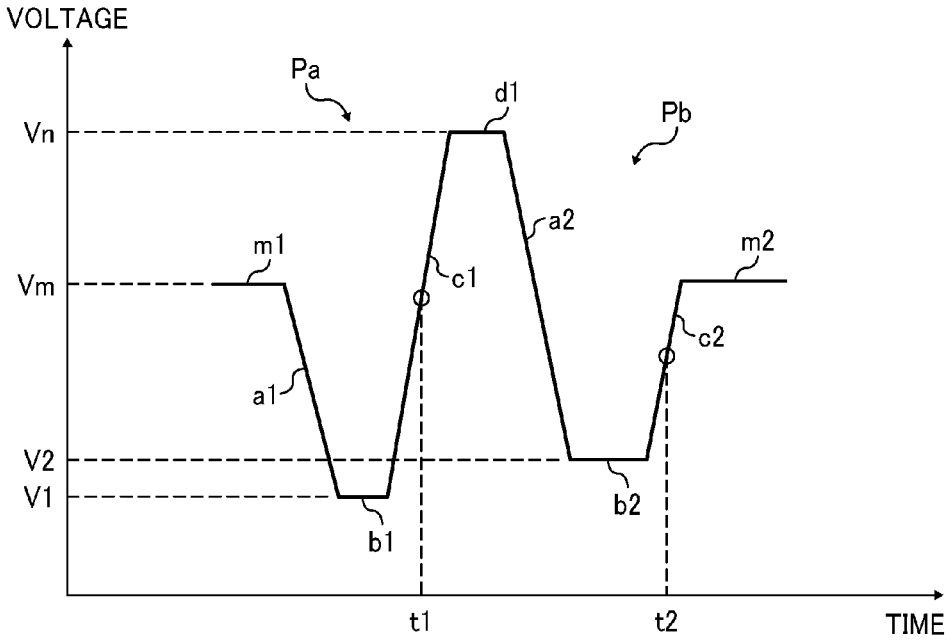
FIG. 7 is a diagram for use in the description of the drive waveform in the first embodiment of the present disclosure.

Next, the drive waveform in the first embodiment of the present disclosure will be described with reference to FIG. 7.

In this embodiment, the drive pulse includes multiple (two in this case) drive pulses Pa and Pb continuously arranged in chronological order. Both the continuous two drive pulses Pa and Pb cause to discharge liquid. The liquid discharged by the two continuous drive pulses Pa and Pb is merged to form a single droplet.

The drive pulse Pa includes an inflation waveform element a1, an inflation holding waveform element b1, and a contraction waveform element c1.

By the inflation waveform element a1, the intermediate voltage (reference voltage) Vm held by a waveform element m1 rises down to the voltage V1 to inflate the individual liquid chamber 106. By the inflation holding waveform element b1, the voltage risen down in the inflation waveform element a1 to the voltage V1 is held to maintain the inflation state. By the contraction waveform element c1, the voltage V1 held during the inflation holding waveform element b1 rises to a voltage Vn (Vn>Vm) greater than the intermediate voltage Vm to contract the individual liquid chamber 106.

The initial voltage of the inflation waveform element a1 of this drive pulse Pa is the intermediate voltage Vm.

A holding waveform element (contraction holding wave element) d1 between pulses that holds the voltage Vn to which the voltage is risen by the contraction waveform element c1 of the drive pulse Pa is arranged between the continuous two drive pulses Pa and Pb.

The drive pulse Pb includes an inflation waveform element a2, an inflation holding waveform element b2, and a contraction waveform element c2.

By the inflation waveform element a2, the voltage Vn held during the holding waveform element d1 between pulses rises down to V2 (Vm>V2>V1) to inflate the individual liquid chamber 106. By the inflation holding waveform element b2, the voltage V2 to which the voltage is risen down in the inflation waveform element a2 is held to maintain the inflation state. By the contraction waveform element c2, the voltage V2 held during the inflation holding waveform element b2 rises to the voltage Vm to contract the individual liquid chamber 106.

The ending voltage of the contraction waveform element c2 of the drive pulse Pb is the intermediate voltage Vm.

The intermediate voltage Vm to which the voltage risen in the contraction waveform element c2 of the drive pulse Pb is held in the waveform element m2.

In the continuous two drive pulses Pa and Pb, the voltage Vn in the holding waveform element d1 between the drive pulse Pa and the drive pulse Pb is above the intermediate voltage Vm, which is the initial voltage of the inflation waveform element a1 of the drive pulse Pa arranged first in chronological order and the intermediate voltage Vm, which is the ending voltage of the contraction waveform element c2 of the last drive pulse Pb in chronological order.

In addition, the discharging interval between the continuous two drive pulses Pa and Pb is within the range of ½×Tc to 2×Tc when the characteristic vibration cycle of the individual liquid chamber 106 is determined as Tc. The discharging interval is determined as the time (t2–t1) between the intermediate point t1 of the start and the end of the contraction waveform element c1 and the intermediate point t2 of the start and the end of the contraction waveform element c2.

Next, the discharging state of the liquid by the continuous two drive pulses Pa and Pb are described with reference to FIG. 8. FIGS. 8A, 8B, 8C, 8D, and 8E are diagrams illustrating the waveform elements and the discharging state used for this description. With regard to the waveform element, corresponding waveform elements are illustrated by solid lines.

Figure 8A:
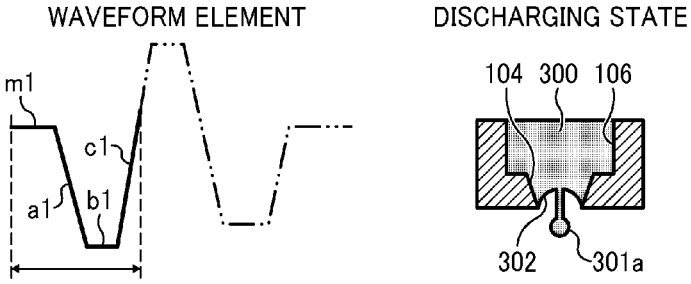
FIGS. 8A, 8B, 8C, 8D, and 8E are diagrams illustrating the description of the discharging state of liquid in the first embodiment illustrated above.

As illustrated in FIG. 8A, the first drive pulse Pa is provided and the intermediate voltage Vm is lowered to the voltage V1 in the inflation waveform element a1. Thereafter, a liquid (first droplet) 301*a* is discharged when the voltage is back from the voltage V1 to the intermediate voltage Vm in the contraction waveform element c1.

Figure 8B:
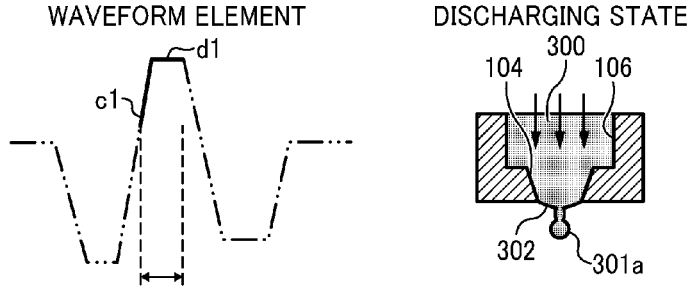

As illustrated in FIG. 8B, when the voltage rises to the voltage Vn which is above the intermediate voltage Vm by the contraction waveform element c1, the individual liquid chamber 106 is contracted more than the initial state to apply a pressure to a liquid 300 when the first droplet 301*a* is discharged. Therefore, the volume of the first droplet 301*a* is increased by extruding the first droplet 301*a*.

Figure 8C:
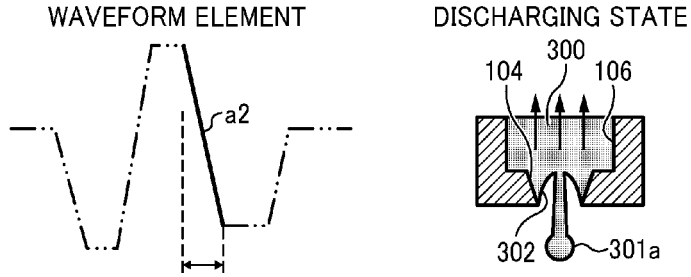

Thereafter, as illustrated in FIG. 8C, the last drive pulse Pb is applied to the contracted state of the individual liquid chamber 106 to cause the voltage to rise down to the voltage V2 in the inflation waveform element a2, thereby inflating the individual liquid chamber 106. As a result, a meniscus 302 is greatly pulled back towards the individual liquid chamber 106 as indicated by the arrows.

Figure 8D:
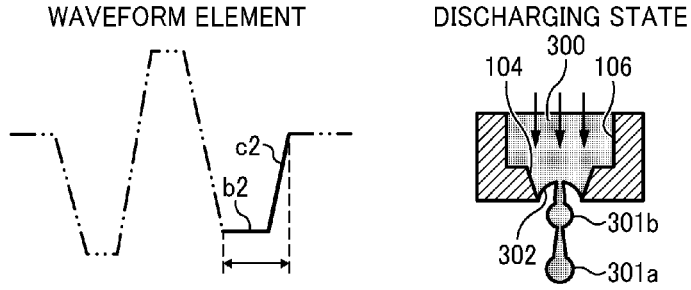

From the state where the meniscus 302 is pulled back, as illustrated in FIG. 8D, the voltage is raised to the intermediate voltage Vm in the contraction waveform element c2 to contract the individual liquid chamber 106 so that a subsequent droplet 301*b* is discharged.

The volume of the subsequent droplet 301*b* increases because the meniscus 302 is greatly pulled back. In addition, when the discharging interval (t2–t1) between the subsequent droplet 301*b* and the first droplet 301*a* is within the range of ½×Tc to 2×Tc, the ligament between the subsequent droplet 301*b* and the first droplet 301*a* is not easily broken off.

Figure 8E:
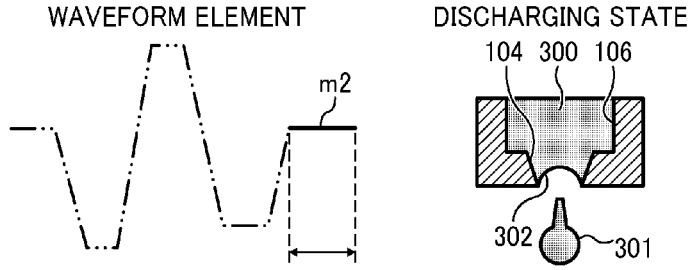

As illustrated in FIG. 8E, the first droplet 301*a* and the subsequent droplet 301*b* are merged in the air to form a single large droplet 301.

Therefore, while suppressing an increase of the waveform length of the drive waveform and a decrease of the drive frequency, the volume of the droplet can be increased.

Figure 9A:
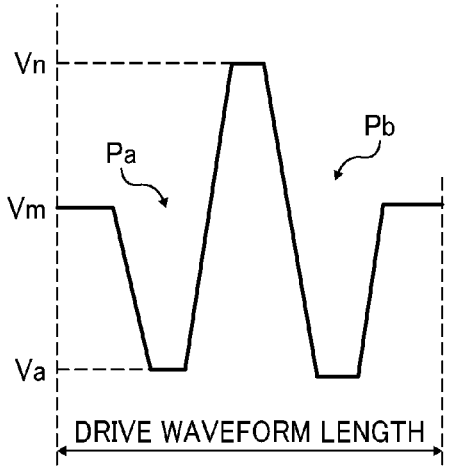
FIGS. 9A, 9B, and 9C are diagrams illustrating the description of suppressing an increase of the drive waveform length in the first embodiment of the present disclosure.

Next, suppression of the increase of the drive waveform length in this embodiment is concretely described with reference to FIG. 9. FIG. 9 is a diagram illustrating the description. FIG. 9A is a diagram illustrating the waveform of the embodiment, FIG. 9B is a diagram illustrating the waveform of Comparative Example 1 to obtain the same droplet volume as FIG. 9A, and FIG. 9C is a diagram illustrating the waveform of Comparative Example 2 to obtain the same droplet volume as FIG. 9A.

First, as illustrated in FIG. 9A, in the configuration of an embodiment in which the voltage (which is held by the holding waveform element between pulses) between the continuous two drive pulses is set to be higher than the intermediate voltage, the discharging volume per drive pulse is, for example, 3.0 pL so that it is possible to form a droplet having a discharging volume of 6.0 pL by the two continuous pulses.

Figure 9B:
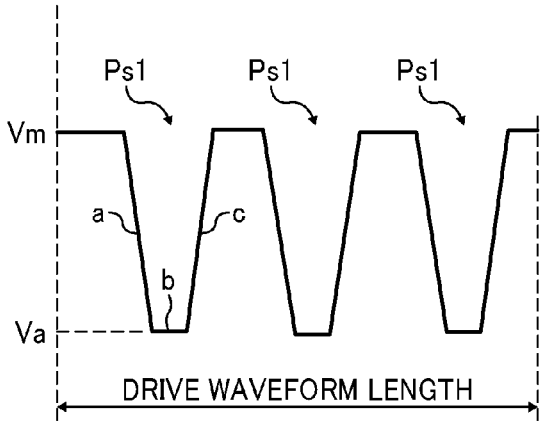
Figure 9C:
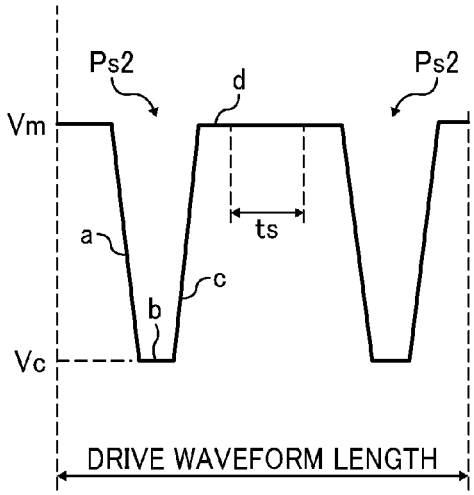

On the other hand, Comparative Example 1 illustrated in FIG. 9B uses a drive pulse Ps1 including an inflation waveform element a where the voltage rises down from the intermediate voltage Vm to the voltage Va (Va<Vm), a holding waveform element b, and a contraction waveform element c where the voltage rises from the voltage Va to the intermediate voltage Vm.

Since the drive pulse Ps1 is a small crest value (voltage Vm−Va), it is possible to shorten the discharging interval until the discharging of the subsequent droplet during continuous discharging. However, since the crest value is small, the discharging volume of the droplet that a single drive pulse Ps1 can discharge is reduced (for example, 2.0 pL).

Therefore, to form a droplet having a discharging volume of 6.0 pL, three of the drive pulses Ps1 are required to be on a par with the embodiment. Therefore, the drive waveform length is longer than the embodiment. If the drive waveform length is prolonged, the drive frequency lowers.

In addition, Comparative Example 2 illustrated in FIG. 9C uses a drive pulse Ps2 including an inflation waveform element a where the voltage rises down from the intermediate voltage Vm to the voltage Vc (Vc<Va<Vm), a holding waveform element b, and a contraction waveform element c where the voltage rises from the voltage Vc to the intermediate voltage Vm.

However, since the crest value of this drive pulse Ps2 is large (Vm−Vc>Vm−Va), the discharging volume of the droplet that a single drive pulse Ps2 can discharge increases (for example, 3.0 pL). However, in the case of continuous discharging, it is necessary to hold discharging of the sequent droplet until the meniscus displacement accompanied by the discharging of the first droplet decays to a degree that no impact occurs to the discharging of the subsequent droplet.

Therefore, to form a droplet having a discharging volume of 6.0 pL, it is necessary to set a waiting time is during which the meniscus displacement decays between the two drive pulses Ps2. Accordingly, the drive waveform length is long in comparison with the embodiment.

As described above, when the voltage for the holding waveform between the continuous drive pulses in chronological order is higher than the initial voltage of the inflation waveform element of the first drive pulse and the ending voltage of the contraction waveform element of the last drive pulse in a configuration, it is possible to increase the droplet volume while suppressing a decrease of the drive frequency.

Figure 10:
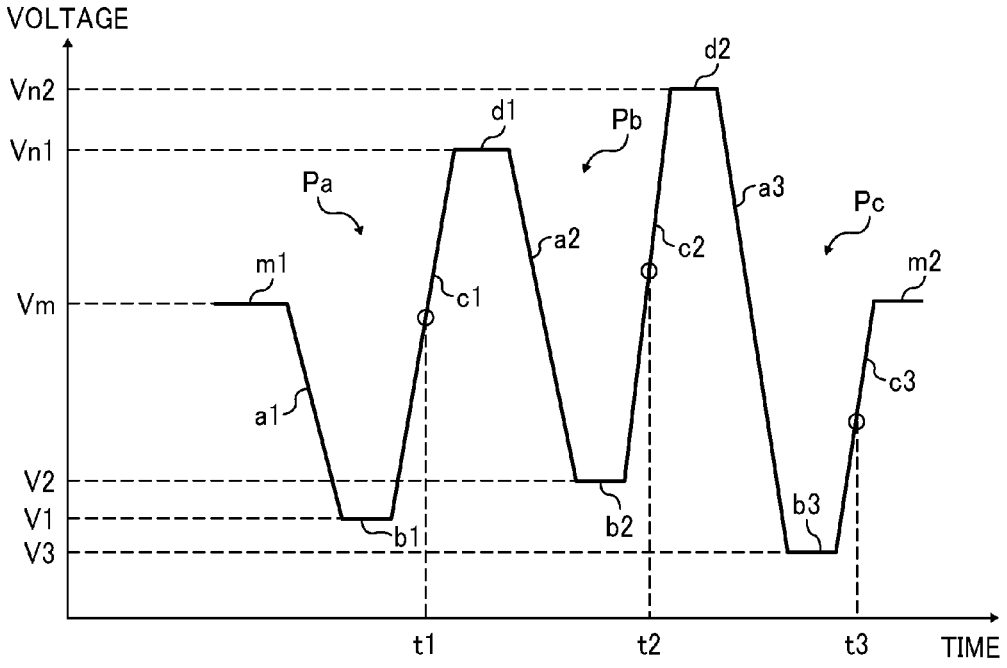
FIG. 10 is a diagram illustrating the description of the drive waveform in the second embodiment of the present disclosure.

Next, the drive waveform of the second embodiment of the present disclosure is described with reference to FIG. 10.

The drive pulse includes three drive pulses Pa, Pb, and Pc continuously arranged in chronological order. Each of the continuous three drive pulses Pa, Pb, and Pc causes liquid to be discharged. Each liquid discharged by the three continuous drive pulses Pa, Pb, and Pc is merged so that a single droplet is formed.

The drive pulse Pa includes an inflation waveform element a1, an inflation holding waveform element b1, and a contraction waveform element c1.

During the inflation waveform element a1, the intermediate voltage Vm held by a waveform element m1 rises down to the voltage V1 to inflate the individual liquid chamber 106. By the inflation holding waveform element b1, the voltage risen down to the voltage V1 in the inflation waveform element a1 is held to maintain the inflation state. By the contraction waveform element c1, the voltage V1 held during the inflation holding waveform element b1 rises to a voltage Vn1 (Vn1>Vm) greater than the intermediate voltage Vm to contract the individual liquid chamber 106.

The initial voltage of the inflation waveform element a1 of this drive pulse Pa is the intermediate voltage Vm.

A holding waveform element (contraction holding wave element) d1 between pulses that holds the voltage Vn1 risen by the contraction waveform element c1 of the drive pulse Pa is arranged between the continuous two drive pulses Pa and Pb.

The drive pulse Pb includes an inflation waveform element a2, an inflation holding waveform element b2, and a contraction waveform element c2.

By the inflation waveform element a2, the voltage Vn1 held during the holding waveform element d1 between pulses rises down to V2 (Vm>V2>V1) to inflate the individual liquid chamber 106. By the inflation holding waveform element b2, the voltage V2 to which the voltage is risen down in the inflation waveform element a2 is held to maintain the inflation state. By the contraction waveform element c2, the voltage V2 held during the inflation holding waveform element b2 rises to a voltage Vn2 (Vn2>Vn1>Vm) greater than the intermediate voltage Vm and the voltage V1 to contract the individual liquid chamber 106.

A holding waveform element (contraction holding waveform element) d2 between pulses that holds the voltage Vn2 risen by the contraction waveform element c2 of the drive pulse Pb is arranged between the continuous two drive pulses Pb and Pc.

The drive pulse Pc includes an inflation waveform element a3, an inflation holding waveform element b3, and a contraction waveform element c3.

By the inflation waveform element a3, the voltage Vn2 held during the holding waveform element d2 between pulses rises down to V3 (Vm>V2>V1>V3) to inflate the individual liquid chamber 106. By the inflation holding waveform element b3, the voltage V3 risen down in the inflation waveform element a3 is held to maintain the inflation state. By the contraction waveform element c3, the voltage V3 held during the inflation holding waveform element b3 rises to the intermediate voltage Vm to contract the individual liquid chamber 106.

The ending voltage of the contraction waveform element c3 of the drive pulse Pc is the intermediate voltage Vm.

The intermediate voltage Vm risen in the contraction waveform element c3 of the drive pulse Pb is held in the waveform element m2.

In the continuous three drive pulses Pa, Pb, and Pc, the voltage in the holding waveform element d1 between the drive pulse Pa and the drive pulse Pb and the voltage in the holding waveform element d2 between the drive pulse Pb and the drive pulse Pc are above the intermediate voltage Vm, which is the initial voltage of the inflation waveform element a1 of the drive pulse Pa arranged first in chronological order and the intermediate voltage Vm, which is the ending voltage of the contraction waveform element c3 of the last drive pulse Pc in chronological order.

In addition, the discharging interval between the drive pulses Pa and Pb and the discharging interval between the drive pulses Pb and Pc are within the range of ½×Tc-2×Tc when the characteristic vibration cycle of the individual liquid chamber 106 is determined as Tc. As described above, the discharging interval is determined as the time between the intermediate point t1 of the start and the end of the contraction waveform element c1 and the time between the intermediate point t2 of the start and the end of the contraction waveform element c2 and the intermediate point t3 of the start and the end of the contraction waveform element c3.

This configuration makes it possible to form a droplet having a larger volume than in the first embodiment.

In the first embodiment and the second embodiment, the number of continuous drive pulses is 2 or 3 but can be 4 or more. In the case of the 4 or more continuous drive pulses, when the voltage for the holding waveform between pulses is higher than the initial voltage of the inflation waveform element of the first drive pulse and the ending voltage of the contraction waveform element of the last drive pulse in chronological order in a configuration, it is possible to increase the droplet volume without prolonging the drive waveform length, that is, while suppressing a decrease of the drive frequency.

Next, different drive waveforms of the third embodiment of the present disclosure are described with reference to FIG. 11.

Figure 11A:
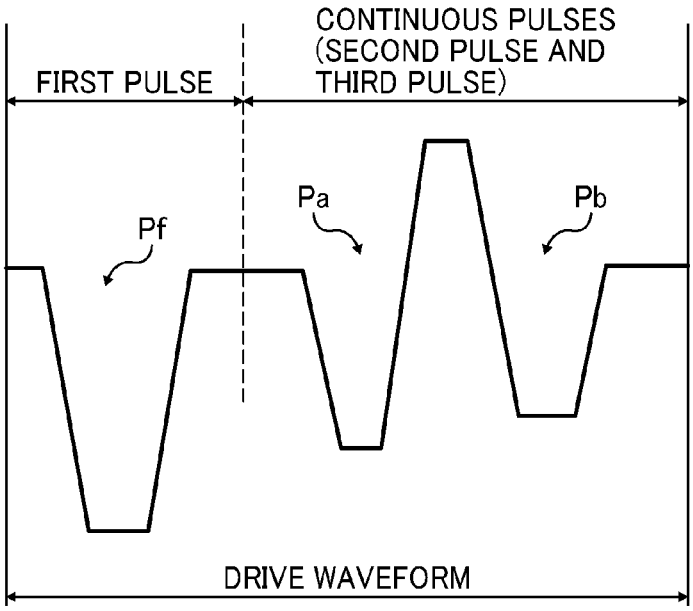
FIGS. 11A and 11B are diagrams illustrating the description of different drive waveforms in the third embodiment of the present disclosure.

The drive waveform of FIG. 11A includes a drive pulse Pf to discharge liquid as the first pulse and two continuous drive pulses Pa and Pb as the second and the third pulse constituting continuous pulses in chronological order. That is, the drive pulse to discharge liquid is arranged before the multiple continuous drive pulses.

In addition, if the three continuous drive pulses Pf, Pa, and Pb are selected, a relatively large droplet (large droplet) can be formed. When the two continuous drive pulses Pa and Pb are selected, a relatively small droplet (small droplet) can be formed.

Figure 11B:
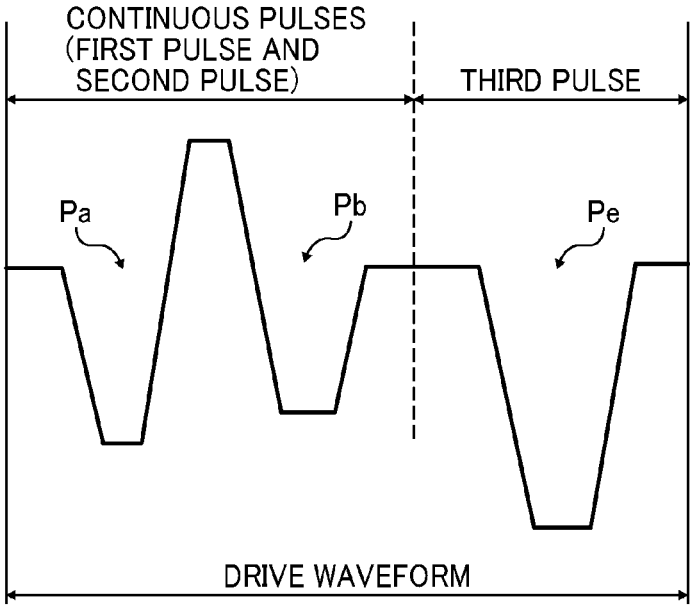

The drive waveform of FIG. 11B includes two continuous drive pulses Pa and Pb as the first and the second pulse constituting continuous pulses and a drive pulse Pe to discharge liquid as the third pulse in time series. That is, the drive pulse to discharge liquid is arranged after the multiple continuous drive pulses.

In addition, if the three continuous drive pulses Pf, Pa, and Pb are selected, a relatively large droplet (large droplet) can be formed. When the two continuous drive pulses Pa and Pb are selected, a relatively small droplet (small droplet) can be formed.

Next, the drive waveform of the fourth embodiment of the present disclosure is described with reference to FIG. 12.

Figure 12A:
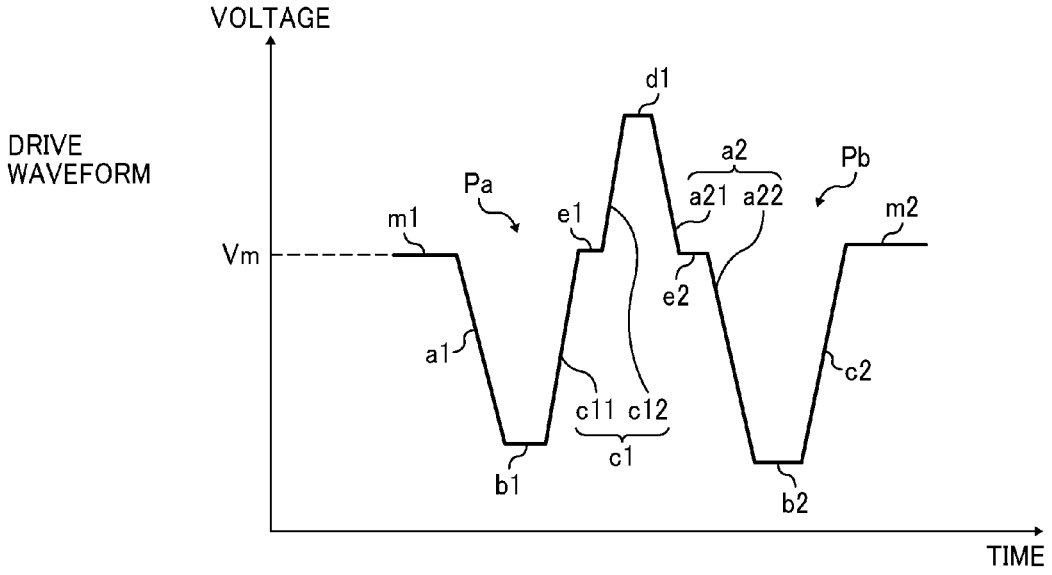
FIGS. 12A and 12B are diagrams illustrating the description of the drive waveform in the fourth embodiment of the present disclosure.

In this embodiment, as illustrated in FIG. 12A, the contraction waveform element c1 of the drive pulse Pa includes a contraction waveform element c11, an intermediate holding waveform element e1, and a contraction waveform element c12 and contracts the individual liquid chamber 106 by two steps.

In the contraction waveform element c11, the voltage (initial voltage of the contraction waveform element c1) held by the inflation holding waveform element b1 rises to a predetermined voltage somewhere between the held voltage and the voltage (the ending voltage of the contraction waveform element c1) held by a holding waveform element d1 between pulses.

The intermediate holding waveform element e1 holds the predetermined voltage risen by the contraction waveform element c11 for a predetermined period of time.

In the contraction waveform element c12, the predetermined voltage held by the intermediate holding waveform element e1 rises to the voltage (ending voltage of the contraction waveform element c1) held by the holding waveform element d1 between pulses.

The inflation waveform element a2 of the drive pulse Pb includes an inflation waveform element a21, an intermediate holding waveform element e2, and an inflation waveform element a22 and inflates the individual liquid chamber 106 by two steps.

In the inflation waveform element a21, the voltage (initial voltage of the inflation waveform element a2) held by the holding waveform element d1 between pulses rises down to a predetermined voltage somewhere between the held voltage and the voltage (the ending voltage of the inflation waveform element a2) held by an inflation waveform element b2.

The intermediate holding waveform element e2 holds the predetermined voltage risen down by the inflation waveform element a22 for a predetermined period of time.

In the inflation waveform element a22, the predetermined voltage held by the intermediate holding waveform element e2 rises down to the voltage (ending voltage of the inflation waveform element a2) held by the inflation holding waveform element b2.

Figure 12B:
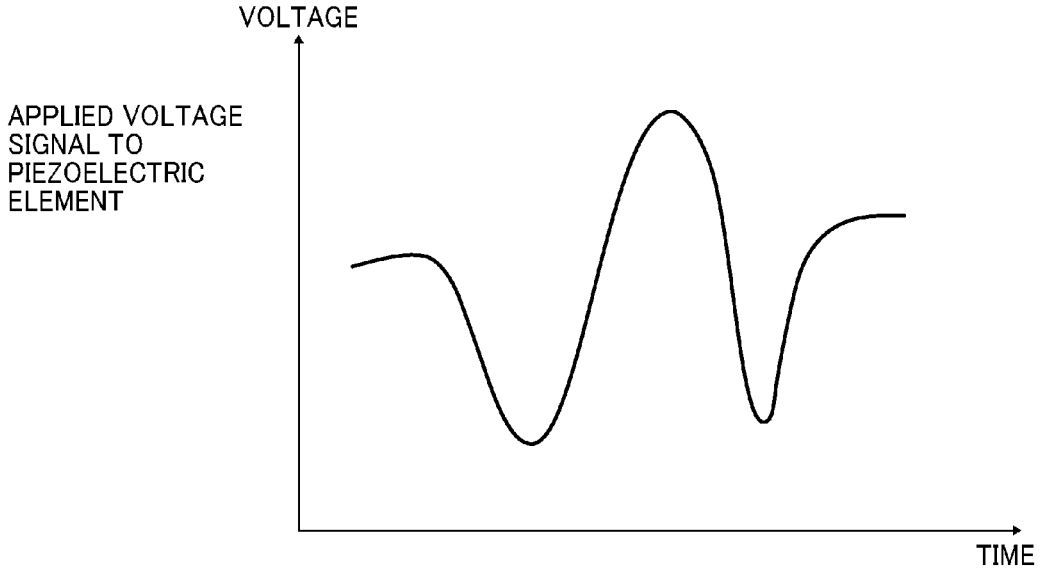

When the intermediate holding waveform element e1 is arranged in the middle of the contraction waveform element c1 and the intermediate holding waveform element e2 is arranged in the middle of the inflation waveform element a2, if the holding time is short, as illustrated in FIG. 12B, a voltage application signal, which is an analog signal provided to the piezoelectric element of a head is dull. Therefore, no step occurs, thereby having no impact on discharging.

The holding time of the intermediate holding waveform element e1 having no impact on discharging is within the range of from 0-0.5×T1 when the sum of the time taken between the initial voltage and the ending voltage (voltage of the intermediate holding waveform element e1) of the contraction waveform element c11 and the time taken between the initial voltage (voltage of the intermediate holding waveform element e1) and the ending voltage of the contraction waveform element c12 is defined as T1.

Similarly, the holding time of the intermediate holding waveform element e2 having no impact on discharging is within the range of from 0-0.5×T2 when the sum of the time between the initial voltage and the ending voltage (voltage of the intermediate holding waveform element e2) of the inflation waveform element a21 and the time between the initial voltage (voltage of the intermediate holding waveform element e2) and the ending voltage of the inflation waveform element a22 is defined as T2.

Figure 13:
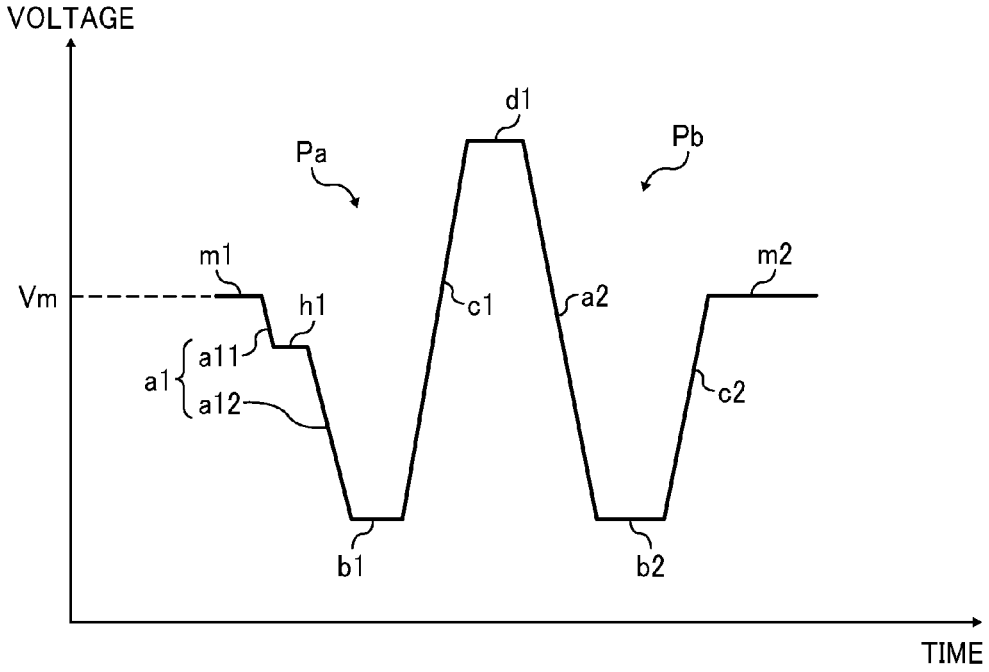
FIG. 13 is a diagram illustrating the description of the drive waveform in the fifth embodiment of the present disclosure.

Next, the drive waveform of the fifth embodiment of the present disclosure is described with reference to FIG. 13.

In this embodiment, the inflation waveform element a1 of the drive pulse Pa includes an inflation waveform element a11, an intermediate holding waveform element h1, and an inflation waveform element a12 and inflates the individual liquid chamber 106 by two steps.

In the inflation waveform element a11, the intermediate voltage Vm (initial voltage of the inflation waveform element a1) rises down to a predetermined voltage somewhere between the intermediate voltage Vm and the ending voltage (voltage held in the inflation holding waveform element a1).

The intermediate holding waveform element h1 holds the predetermined voltage risen down in the inflation waveform element a11 for a predetermined period of time.

In the inflation waveform element a12, the predetermined voltage held in the intermediate holding waveform element h1 rises down to the ending voltage (voltage held in the inflation holding waveform element b1) of the inflation waveform element a1.

When the individual liquid chamber 106 is inflated by two steps by the inflation waveform element a1 of the first drive pulse Pa, the meniscus is slowly drawn so that the discharging droplet is not deviated by the first drive pulse Pa.

Figure 14:
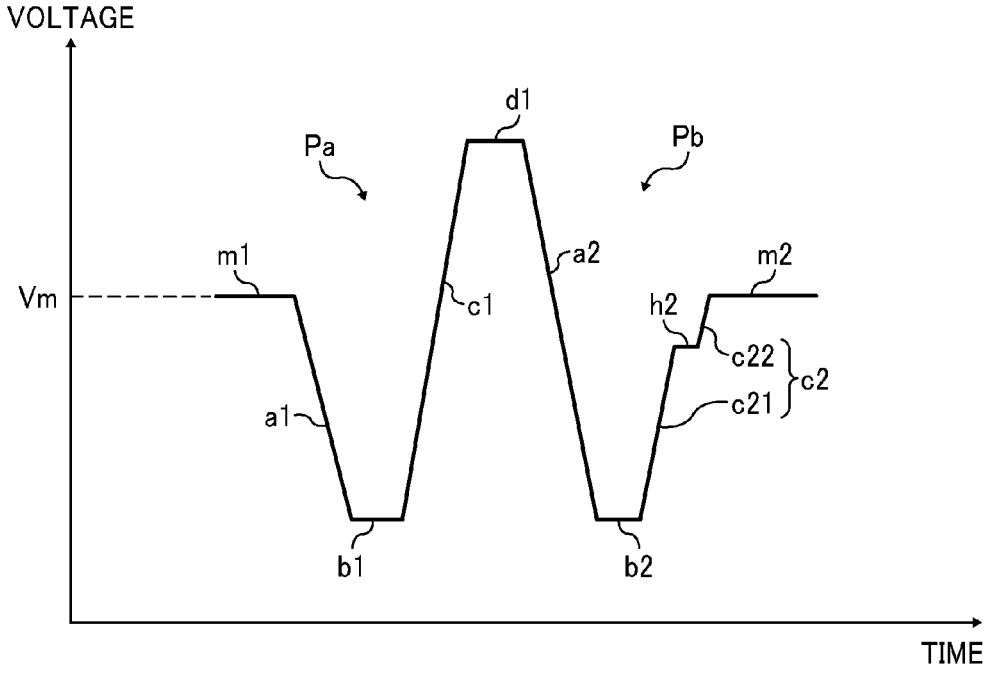
FIG. 14 is a diagram illustrating the description of the drive waveform in the sixth embodiment of the present disclosure.

Next, the drive waveform of the sixth embodiment of the present disclosure is described with reference to FIG. 14.

In this embodiment, the contraction waveform element c2 of the drive pulse Pb includes a contraction waveform element c21, an intermediate holding waveform element h2, and a contraction waveform element c22 and contracts the individual liquid chamber 106 by two steps.

In the contraction waveform element c21, the held voltage by the inflation holding waveform element b2 rises to a predetermined voltage somewhere between the held voltage and the intermediate voltage Vm (the ending voltage of the contraction waveform element c2).

The intermediate holding waveform element h2 holds the predetermined voltage risen by the contraction waveform element c21 for a predetermined period of time.

In the contraction waveform element c22, the predetermined voltage held by the intermediate holding waveform element h2 rises to the intermediate voltage Vm (ending voltage of the contraction waveform element c12).

When the individual liquid chamber 106 is contracted by two steps by the contraction waveform element c of the subsequent (last in this case) drive pulse Pb, the discharging droplet by the subsequent drive pulse Pb can be discharged at an appropriate speed to be merged with the first droplet without pushing the discharging droplet at once. That is, it can be prevented that if the individual liquid chamber is contracted and the subsequent droplet is pushed out at once by the contraction waveform element, the discharging speed of the droplet becomes excessively fast, thereby deviating the direction of the discharging droplet.

Figure 15:
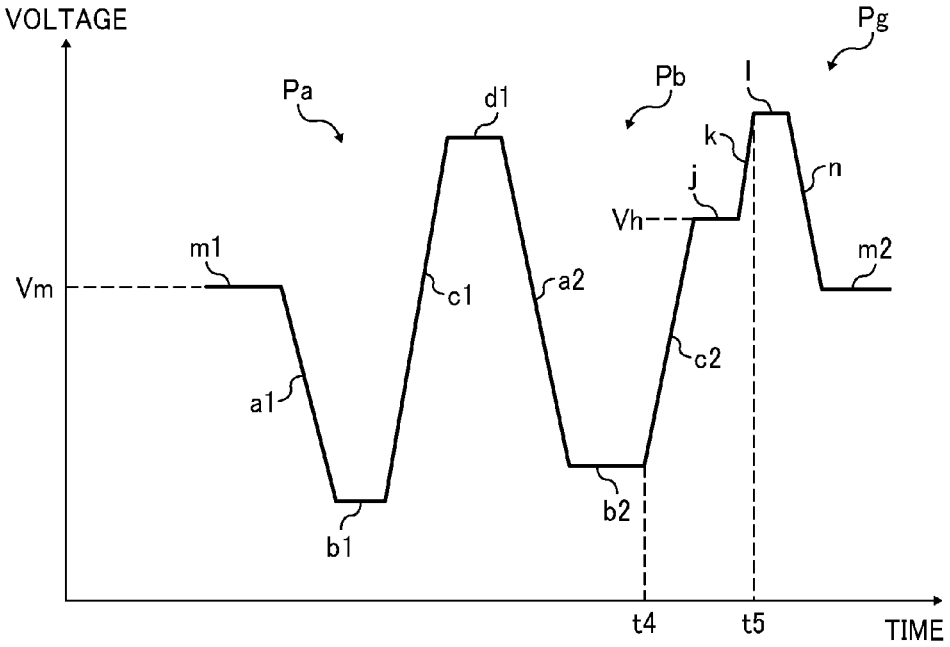
FIG. 15 is a diagram illustrating the description of the drive waveform in the seventh embodiment of the present disclosure.

Next, the drive waveform of the seventh embodiment of the present disclosure is described with reference to FIG. 15.

In this embodiment, in the contraction waveform element c2 of the drive pulse Pb, the voltage rises to a voltage Vh (Vh>Vm) higher than the intermediate voltage Vm and lower than the voltage held in the holding waveform element d between pulses. The ending voltage of the contraction waveform element c2 of the drive pulse Pb is not necessarily the intermediate voltage Vm.

A vibration suppressing pulse Pg to suppress meniscus vibration is arranged in chronological order after the drive pulse Pb.

The vibration suppressing pulse Pg includes a contraction waveform element k forming the suppressing vibration portion risen from a holding waveform element j that holds an ending voltage Vh of the contraction waveform element c2 of the drive pulse Pb, a holding waveform element 1, and an inflation waveform element n rising down to the intermediate voltage Vm. The intermediate voltage Vm risen in the contraction waveform element n is held in the waveform element m2.

The time between the initial point t4 of the contraction waveform element c2 of the drive pulse Pb and the ending point t5 of the contraction waveform element k of the vibration suppressing pulse Pg is within the range of from ½×Tc-3×Tc when the characteristic vibration cycle is defined as Tc.

When the vibration suppressing pulse Pg is arranged, the meniscus vibration is quickly decayed to be ready for the next droplet discharging.

Figure 16:
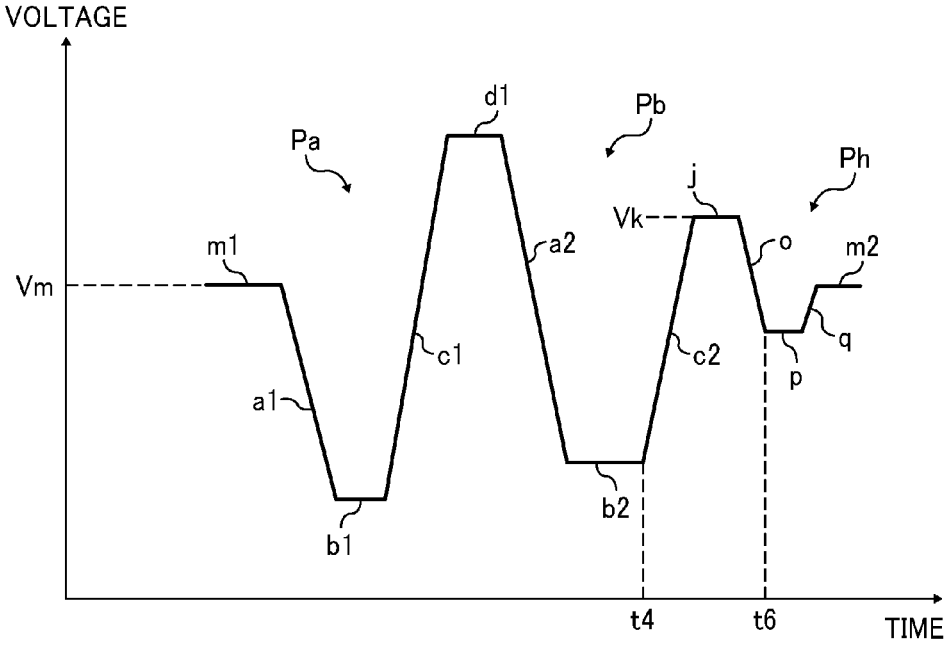
FIG. 16 is a diagram illustrating the description of the drive waveform in the eighth embodiment of the present disclosure.

Next, the drive waveform of the eighth embodiment of the present disclosure is described with reference to FIG. 16.

In this embodiment, in the contraction waveform element c2 of the drive pulse Pb, the voltage rises to a voltage Vk (Vk>Vm) higher than the intermediate voltage Vm and lower than the voltage held in the holding waveform element d between pulses.

A vibration suppressing pulse Ph to suppress meniscus vibration is arranged in chronological order after the drive pulse Pb.

The vibration suppressing pulse Ph includes an inflation waveform element o forming the suppressing vibration portion risen down from a holding waveform element j that holds the ending voltage of the contraction waveform element c2 of the drive pulse Pb, a holding waveform element p, and a contraction waveform element q rising to the intermediate voltage Vm. The intermediate voltage Vm risen in the contraction waveform element q is held in the waveform element m2.

The time between the final point t4 of the holding waveform element b2 of the drive pulse Pb and the end point t6 of the inflation waveform element o of the vibration suppressing pulse Ph is within the range of from ½×Tc-3×Tc when the characteristic vibration cycle is defined as Tc.

When the vibration suppressing pulse Ph is arranged, the meniscus vibration is quickly decayed to be ready for the next droplet discharging.

The device to discharge liquid in the present disclosure is capable of discharging liquid to an article to which liquid is attachable.

According to the present disclosure, the volume of a droplet can be increased while suppressing a decrease of the drive frequency.

The device to discharge liquid may include not only a portion to discharge liquid but also a device relating to feeding, conveying, ejecting recording media, and other devices referred to as a pre-processing device, a post-processing device, etc.

In addition, the device to discharge liquid includes typical devices such as a recording device, a printing device, an image forming apparatus, a droplet discharging device, a liquid discharging device, a process liquid applicator, and a 3D manufacturing device.

In addition, the device to discharge a liquid is not limited to those which produce meaningful images such as texts and figures using the discharged liquid. For example, the device to discharge a liquid may form meaningless patterns or 3D images.

What the liquid is attachable means what the liquid can be attached even temporarily. When alternative terms such as sheets, media, recording media, recording sheets, recording paper, powder layer are used instead of the wording of what the liquid is attachable, the wording includes what any kinds of liquids can be attached unless otherwise specified.

Specific examples of the materials of what a liquid can be attached include anything to which a liquid can be attached even temporarily, such as paper, thread, fiber, cloth, leather, metal, plastic, glass, wood, and ceramics.

In addition, the liquid includes ink, process liquid, DNA sample, resists, pattern materials, and binding agents.

The device to discharge a liquid includes both a serial type device in which the liquid discharging head is caused to move and a line type device in which the liquid discharging head is not caused to move, unless otherwise specified.

The liquid discharging unit represents a part integrated with a portion causing to discharge a liquid. For example, the liquid discharging unit includes a combination of a liquid discharging head and at least one of a head tank, a carriage, a supplying mechanism, a maintenance and recovery mechanism, and a main scanning moving mechanism.

For example, the liquid discharging unit includes a part in which a liquid discharging head is integrated with a head tank, a part in which a liquid discharging head is integrated with a carriage, and a part in which a liquid discharging head is integrated with a head tank and a carriage.

Also, it is possible to add a filter unit to those.

In addition, the liquid discharging unit includes a part in which a liquid discharging head is integrated with a maintenance mechanism, a part in which a liquid discharging head is integrated with a maintenance mechanism and a main scanning moving mechanism, and a part in which a liquid discharging head is integrated with a main scanning moving mechanism and a supplying mechanism.

The main scanning mechanism is configured by combining a carriage, a guiding member to guide the carriage, or a combination of those with a drive source and a moving mechanism of the carriage. The supplying mechanism includes a mounting unit to which a main tank is mounted, a tube, a head tank, etc. The maintenance mechanism is a combination of at least two of a cap, a wiper, a suction device such as a suction pump connected with the cap, and a dummy discharging receiver.

Furthermore, the liquid discharging unit may have a configuration in which the mechanism to transfer what a liquid is attached from the mechanism described in the embodiments.

In addition, the liquid discharging head has no specific limit with regard to a pressure generating device used therein. For example, other than the piezoelectric actuator (may use a laminate type piezoelectric element) in the embodiments described above, it is possible to use a thermal actuator using the thermoelectric conversion element such as a heat element and an electrostatic actuator including a vibration plate and a counter electrode. For example, other than the piezoelectric actuator (may use a laminate type piezoelectric element) in the embodiments described above, it is possible to use a thermal actuator using the thermoelectric conversion element such as a heat element and an electrostatic actuator including a vibration plate and a counter electrode.

Moreover, image forming, recording, printing, modeling, etc. in the present disclosure represent the same meaning.

What is claimed is:

1. A device to discharge liquid comprising:

a liquid discharging head configured to discharge liquid; and a drive waveform generating device configured to generate and output a drive waveform;

wherein the drive waveform includes continuous multiple drive pulses to discharge the liquid from the liquid discharging head that are continuously arranged in chronological order to discharge the liquid to form a single droplet of the liquid, wherein the continuous multiple drive pulses include a first inflation waveform element configured to inflate an individual liquid chamber of the liquid discharging head and a first contraction waveform element configured to contract an inflated individual liquid chamber to discharge the liquid, and wherein when a wave element between the continuous multiple drive pulses is determined as a holding wave element between pulses, of the continuous multiple drive pulses, a voltage held by the holding waveform element between pulses is higher than each one of a first initial voltage of the first inflation waveform element of a first drive pulse in chronological order and a first ending voltage of the first contraction waveform element of a last drive pulse in chronological order.

2. The device according to claim 1, wherein when a characteristic vibration cycle of the individual liquid chamber is determined as Tc, a discharging interval by the continuous multiple drive pulses is within a range of ½×Tc-2×Tc.

3. The device according to claim 1, wherein the first inflation waveform element of the first drive pulse includes an intermediate holding waveform that holds a first predetermined voltage between the first initial voltage and a second ending voltage of the first inflation waveform element for a first predetermined period of time.

4. The device according to claim 3, wherein the first predetermined period of time is not greater than ½ of a total time of a first period of time from the first initial voltage to the first predetermined voltage and a second period of time from the first predetermined voltage to the second ending voltage.

5. The device according to claim 1, wherein the first contraction waveform element of the last drive pulse includes an intermediate holding waveform that holds a second predetermined voltage between a second initial voltage and the first ending voltage of the first contraction waveform element for a second predetermined period of time.

6. The device according to claim 1, wherein the drive waveform includes a first vibration suppressing pulse having a second contraction waveform element to contract the individual liquid chamber without discharging the liquid after the last drive pulse in chronological order and wherein when a characteristic vibration cycle of the individual liquid chamber is determined as Tc, a first period of time from an initial point of the first contraction waveform element of the last drive pulse to a first end point of the second contraction waveform element of the first vibration suppressing pulse is within a range of ½×Tc-2×Tc.

7. The device according to claim 1, wherein the drive waveform includes a second vibration suppressing pulse having a second inflation waveform element to inflate the individual liquid chamber after the last drive pulse in chronological order and wherein when a characteristic vibration cycle of the individual liquid chamber is determined as Tc, a second period of time from an initial point of the first contraction waveform element of the last drive pulse to a second end point of the second inflation waveform element of the second vibration suppressing pulse is within a range of ½×Tc-2×Tc.

8. The device according to claim 1, wherein a drive pulse to discharge the liquid is arranged at least before or after the continuous multiple drive pulses in chronological order in the drive waveform.

9. A head driving method comprising:

generating and outputting a drive waveform including continuous multiple drive pulses that are continuously arranged in chronological order to discharge the liquid to form a single droplet of the liquid; and applying the continuous multiple drive pulses to a liquid discharging head to discharge liquid therefrom, wherein the continuous multiple drive pulses includes a first inflation waveform element configured to inflate an individual liquid chamber of the liquid discharging head and a first contraction waveform element configured to contract the individual liquid chamber which is inflated to discharge the liquid, and wherein when a wave element between the continuous multiple drive pulses is determined as a holding wave element between pulses, of the continuous multiple drive pulses, a voltage held by the holding waveform element between pulses is higher than each one of a first initial voltage of the first inflation waveform element of a first drive pulse in chronological order and a first ending voltage of the first contraction waveform element of a last drive pulse in chronological order.

* * * * *